US008555830B2

(12) United States Patent
Lockshaw et al.

(10) Patent No.: US 8,555,830 B2
(45) Date of Patent: Oct. 15, 2013

(54) ORBITAL, NON-RECIPROCATING, INTERNAL COMBUSTION ENGINE

(76) Inventors: James Lockshaw, Paso Robles, CA (US); Joseph Gerondale, Huntington Beach, CA (US)

( * ) Notice: Subject to any disclaimer, the term of this patent is extended or adjusted under 35 U.S.C. 154(b) by 0 days.

(21) Appl. No.: 13/273,587

(22) Filed: Oct. 14, 2011

(65) Prior Publication Data

US 2013/0092121 A1 Apr. 18, 2013

(51) Int. Cl.
*F02B 75/18* (2006.01)

(52) U.S. Cl.
USPC ..... 123/52.1; 123/232; 123/238; 123/206.1; 123/195 R; 123/193.1

(58) Field of Classification Search
USPC ..... 123/43 R, 45 R, 52.1, 78 C, 197.1, 205
See application file for complete search history.

(56) References Cited

U.S. PATENT DOCUMENTS

| | | | | |
|---|---|---|---|---|
| 868,100 | A | 10/1907 | Krehbiel | |
| 1,109,270 | A | 9/1914 | Wallis | |
| 1,215,922 | A | 2/1917 | Fasnacht | |
| 1,705,130 | A | 3/1929 | McKlusky | |
| 1,742,706 | A | 1/1930 | Hermann | |
| 1,817,370 | A | 8/1931 | Hammerstrom | |
| 2,078,748 | A * | 4/1937 | Wenzel | 277/462 |
| 2,894,496 | A | 7/1959 | Townsend | |
| 3,043,234 | A | 7/1962 | Poulin | |
| 3,084,562 | A | 4/1963 | Fitzpatrick | |
| 3,105,473 | A | 10/1963 | Johns | |
| 3,353,519 | A | 11/1967 | Reichart | |
| 3,550,565 | A | 12/1970 | Sanchez | |
| 3,942,913 | A | 3/1976 | Bokelman | |
| 4,236,496 | A | 12/1980 | Brownfield | |
| 4,432,314 | A | 2/1984 | Pekelis | |
| 4,530,316 | A | 7/1985 | Morrison | |
| 4,531,481 | A | 7/1985 | Haynes | |
| 4,836,149 | A | 6/1989 | Newbold | |
| 5,343,832 | A | 9/1994 | Murray | |
| 6,457,443 | B1 | 10/2002 | Lillbacka | |
| 6,526,925 | B1 | 3/2003 | Green, Jr. | |
| 6,591,791 | B2 | 7/2003 | DeBei | |

(Continued)

OTHER PUBLICATIONS

Notice of Allowance and Fee(s) Due, U.S. Appl. No. 12/567,759, filed Sep. 26, 2009 for Orbital, Non-Reciprocating, Internal Combustion Engine, Inventor James Lockshaw.

(Continued)

*Primary Examiner* — Lindsay Low
*Assistant Examiner* — Kevin Lathers
(74) *Attorney, Agent, or Firm* — Davis Wright Tremaine LLP

(57) ABSTRACT

A combustible fluid-operated orbital engine having sets of cooperating cylinder and piston members with respective parallel axes of rotation. Respective cylinder and piston carrier wheels with respective axes of rotation parallel to the piston/cylinder axes of rotation carrying the pistons/cylinders circularly and orbitally and at all times in opposed relation on a common longitudinal axis along intersecting counter paths. Respective gearing structures or belts/sprockets supported by the cylinder and piston carrier wheels rotate the pistons/cylinders counter to their circular motion direction to maintain their opposed relation for their periodic interfittment when their respective paths intersect. A combustible fluid supply is provided to the cylinder member for combustion coincident with the periodic interfittment in engine operating relation. The pistons/cylinders may include ceramic material. The compression sealing system is located in the entry of each cylinder rather than being connected to the piston.

20 Claims, 19 Drawing Sheets

(56) References Cited

U.S. PATENT DOCUMENTS

| | | | | |
|---|---|---|---|---|
| 6,615,793 | B1 | 9/2003 | Usack | |
| 6,705,202 | B2 | 3/2004 | Harcourt et al. | |
| 6,779,433 | B2 | 8/2004 | Brosch et al. | |
| 7,341,042 | B1 | 3/2008 | Chung et al. | |
| 7,721,687 | B1 * | 5/2010 | Lockshaw et al. | 123/52.1 |
| 8,161,924 | B1 * | 4/2012 | Lockshaw et al. | 123/52.1 |
| 2004/0099228 | A1 | 5/2004 | Roberts | |
| 2008/0283002 | A1 | 11/2008 | Mantheakis et al. | |

OTHER PUBLICATIONS

U.S. Appl. No. 13/273,587, filed Oct. 14, 2011, Lockshaw et al.
Lockshaw, James et al. International Search Report, PCT/US2012/059695 filed Oct. 11, 2012. Search report dated Mar. 25, 2013.

* cited by examiner

ORBITAL, NON-RECIPROCATING, INTERNAL COMBUSTION ENGINE

FIELD OF THE INVENTION

Embodiments of the present invention relate generally to internal combustion engines, and more specifically, to orbital, non-reciprocating internal combustion engines.

BACKGROUND OF THE INVENTION

The Otto Cycle engine is a reciprocating internal combustion engine. Many of the key work-producing components of the Otto Cycle engine reciprocate, that is they are required to move in a first direction, stop, and then move in a second, opposite direction in order to complete the cycle. In the Otto Cycle engine, there are four changes of direction of the piston assembly in effecting a single power stroke. Piston assemblies (e.g., pistons, rings, wrist pins and connecting rods) travel up into their respective cylinders at a changing rate of speed to top dead center (i.e., to the end of the stroke), where they stop and then return down the cylinder to the bottom of the stroke. The connecting rod, traveling with the piston and articulating at the wrist pin and orbiting at the crankshaft presents a changing angular force that results in side loading of the piston against the cylinder wall. This causes frictional losses. Because of acceleration and deceleration of the piston components in their movements, the internal combustion reciprocating engine requires a flywheel to moderate these energy surges, but this is an imperfect solution and there remain energy-consuming effects.

The Otto Cycle engine also employs the piston/cylinder relationship to pump air into the cylinder (through reciprocating valves) to support combustion and then to pump the exhaust gases out of the cylinder through reciprocating valves. A significant amount of the engine power is used to achieve the pumping action and two revolutions of the crankshaft are required to effect one power stroke.

SUMMARY

The engine design of the present invention, termed the CIRCLE CYCLE™ engine (hereinafter "CC engine"), changes some of the basic mechanical principles of the Otto Cycle engine. Instead of a reciprocating motion, the CC engine design employs a non-reciprocating orbital motion of pistons and cylinders. Thus, the CC engine has no engine block, no crankshaft or associated connecting rods, no separate flywheel, intake or exhaust valves or water pump, nor their supporting hardware.

Instead, the CC engine's pistons and cylinders are each attached to their own respective carrier or drive wheels. By arranging and maintaining the relationship and the position of the piston drive wheel relative to the position of the cylinder drive wheel, an overlap of the piston/cylinder paths can be achieved. This union of the piston and cylinder paths represents the "stroke" of the CC engine. The piston wheel and the cylinder wheel rotate in opposite directions on their respective (and parallel) axes, and the individual pistons and cylinders carried thereby are in orbital motion, circling the wheel axes but at the same time counter rotating about their own respective axes to keep, at all times, in position for interfittment. That is, respective sets of pistons and cooperating cylinders share a common longitudinal axis regardless of their relative positioning on their respective wheels.

A working unit, a set comprising a piston and mating cylinder, always stays aligned throughout 360 degrees of rotation of the piston wheel and the cylinder wheel. Simply put, a piston always points toward its associated cylinder in the set or unit and a cylinder is pointed open towards its associated piston. There are thus no angular forces pushing the piston against the cylinder walls and causing friction. This is in contrast to radial piston/cylinder disposition systems where the axial alignment is transitory and local. In the CC engine, the aforementioned longitudinal alignment, wherein the cylinder/piston angle is no greater than about 0 degrees, enables both compression and combustion forces to be directly in line with piston/cylinder center lines as further explained below.

The pistons and cylinders of the present invention are always oriented the same way, for interfittment along a common longitudinal axis, avoiding side loading. In some embodiments, the pistons and cylinders of the CC engine are maintained oriented by gears to keep them in the desired relative positions. In other embodiments, sprockets and toothed belts may be used.

Unlike the Otto Cycle engine whose maximum lever arm or torque is achieved when the piston is half-way through its power stroke, the CC engine increases its lever arm through the full distance of the power stroke. The CC engine lever arm is 250% greater than the Otto Cycle engine lever arm; the stroke is 166% longer (as a factor of a typical cylinder bore), and each cylinder completes a power stroke with each, not every other, revolution of the engine, allowing the CC engine to achieve high horsepower at low RPM's, meaning more moderate engine speeds, more work and less friction wear in operating the engine. These mechanical advantages add markedly to fuel efficiency.

Both the cylinder and the piston carrier assemblies act as linked flywheels. All engine components having mass are rotating/orbiting about the wheels' axes of rotation and are always in balance. Because pistons and cylinders are orbiting and thus not changing their direction of motion or their velocity (except in relation to engine speed), energy that is lost in Otto Cycle reciprocating engines is conserved in the CC engine.

The CC engine is in some embodiments operable by a liquid combustible fuel such as gasoline, diesel, biodiesel, etc. In other embodiments, the CC engine is operable with gaseous combustible fluids such as natural gas, propane, etc. As described below, some embodiments do not require intake or exhaust valves, which offers increased engine efficiency and simplicity.

As discussed below with reference to the drawings, the CC engine features of lightness, low cost, and simplicity in construction make it ideal for employment as an electrical generator or power transfer device. In some embodiments, high strength permanent magnets are positioned on or in concert with the piston/cylinder carrier wheels without any direct electrical connection between them, providing a core for the electrical generator. Power is then developed through stationary stator coils that are attached to the CC engine's frame or housing and controlled with solid-state power management electronics. Thus, a single CC engine/generator can provide the electrical needs of a house, car, well pump, boat or any other electrically powered device.

For a CC engine, friction, pumping, cooling, and even vibration losses are reduced substantially, perhaps as much as 50%, compared to current designs. Add in combustion efficiency, lowered weight, and reduced manufacturing costs due to simplicity and inexpensive materials relative to current Otto Cycle engines, and it is apparent that the CC engine is a giant step forward in meeting the world's engine modernization needs.

DETAILED DESCRIPTION OF THE PREFERRED EMBODIMENT

Figure 1:
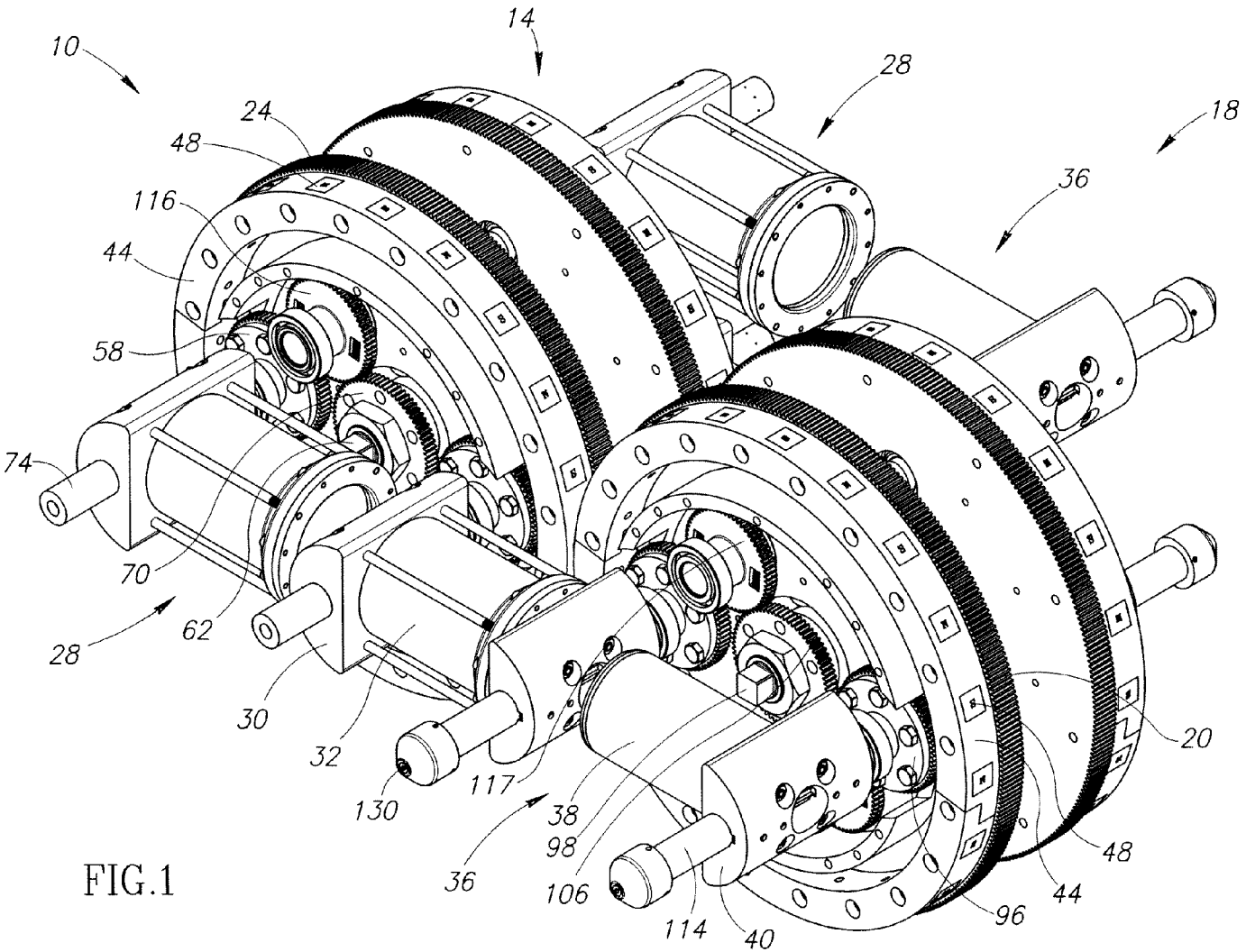
FIG. 1 is a perspective view of a cylinder drive wheel assembly and a piston drive wheel assembly of an engine according to a four cylinder embodiment of the present invention having two banks of two cylinder/piston sets.
Figure 2A:
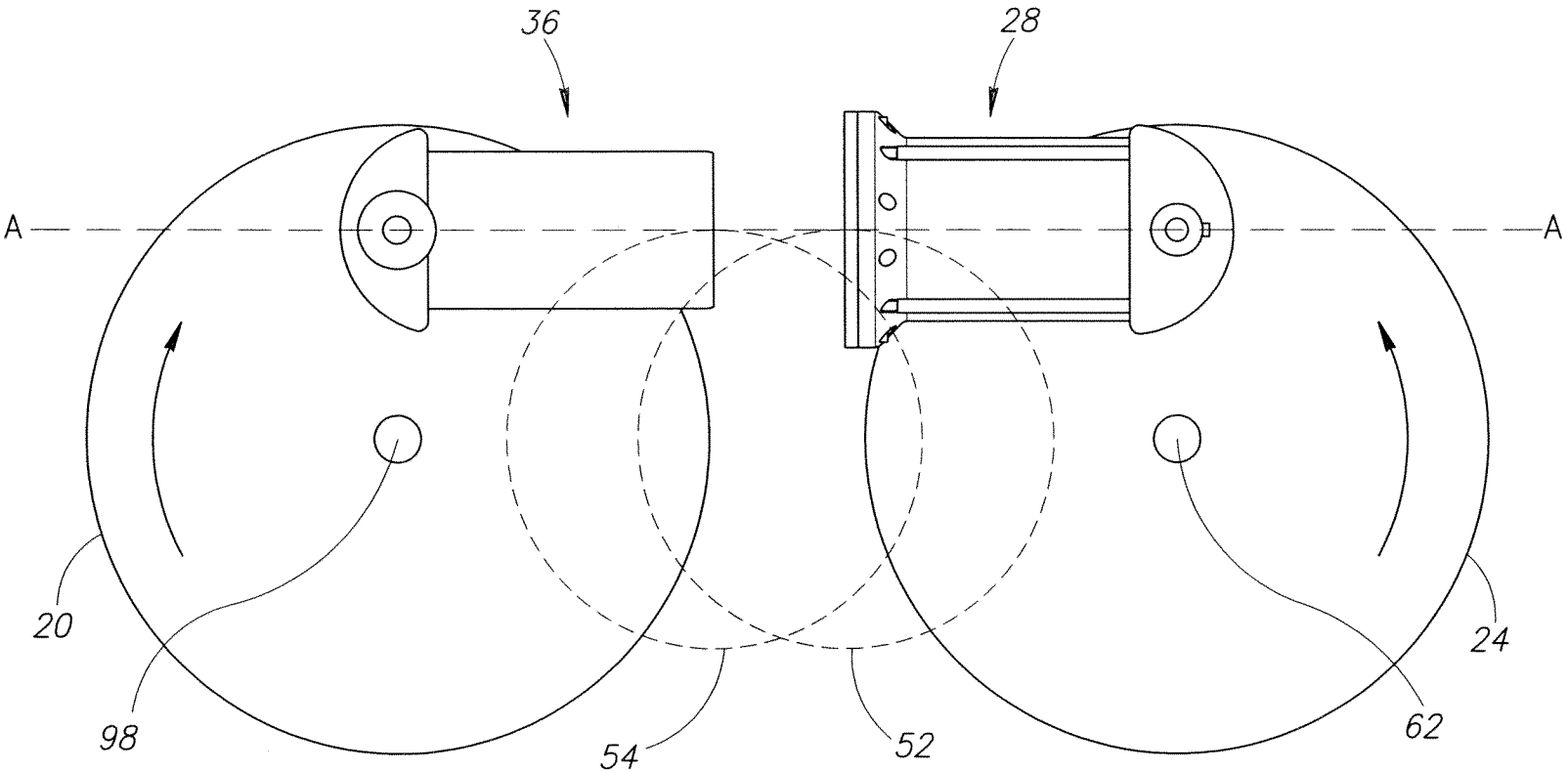
FIGS. 2A-2D are progressive schematic depictions of a side elevation view of the engine with the piston and cylinder approaching, interfitting, and withdrawing as a result of their travel paths as defined by their respective carrier wheels.
Figure 2B:
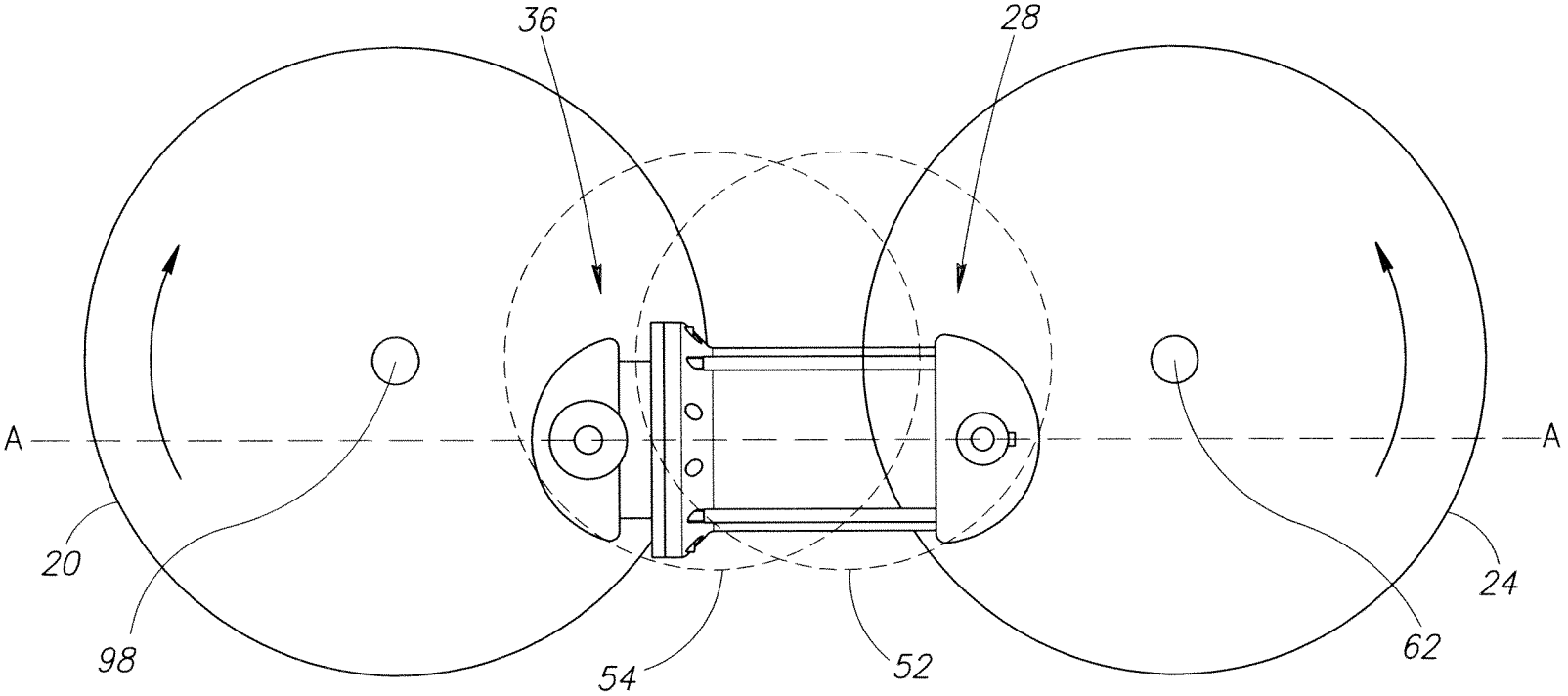
Figure 2C:
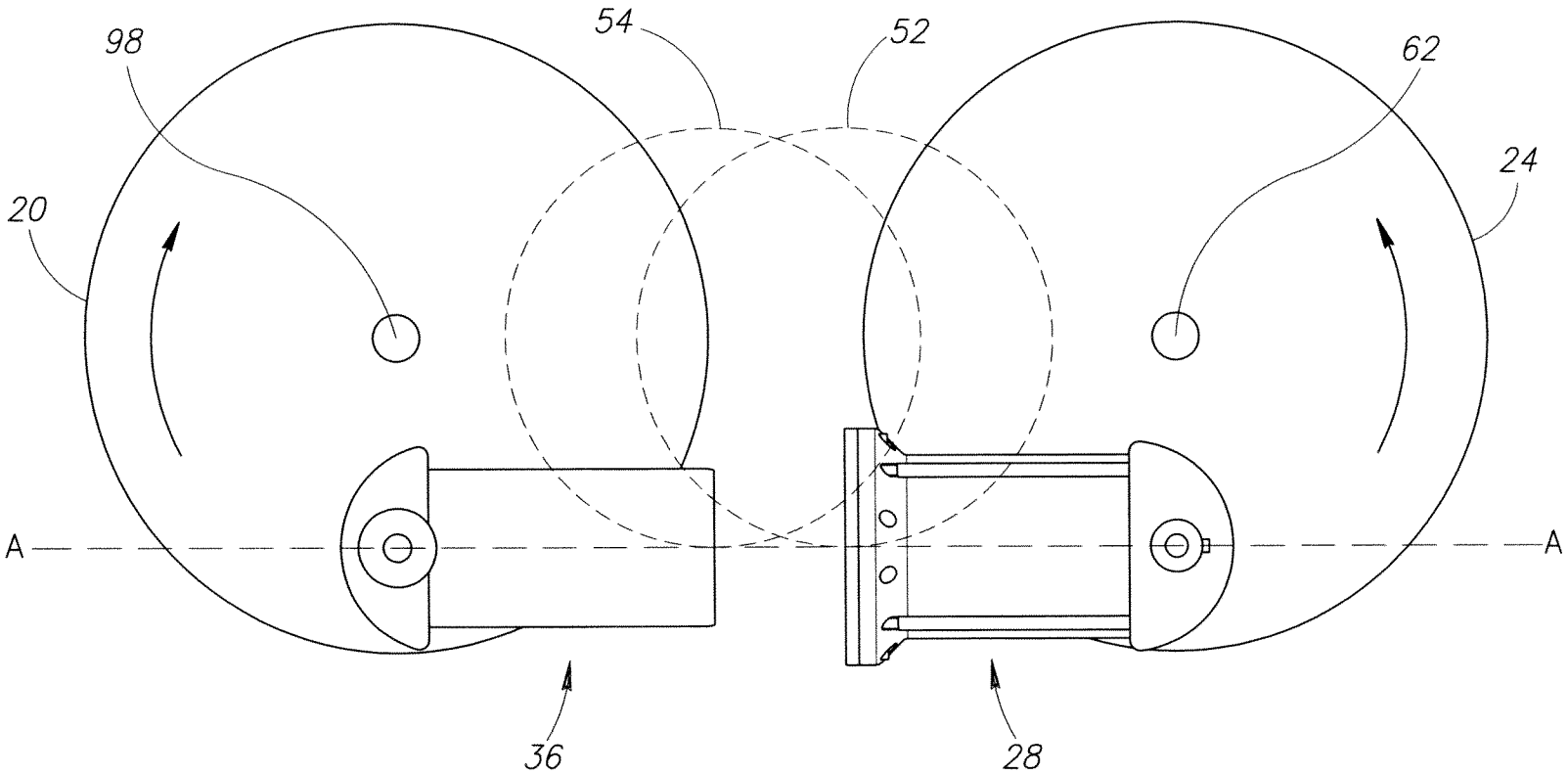
Figure 2D:
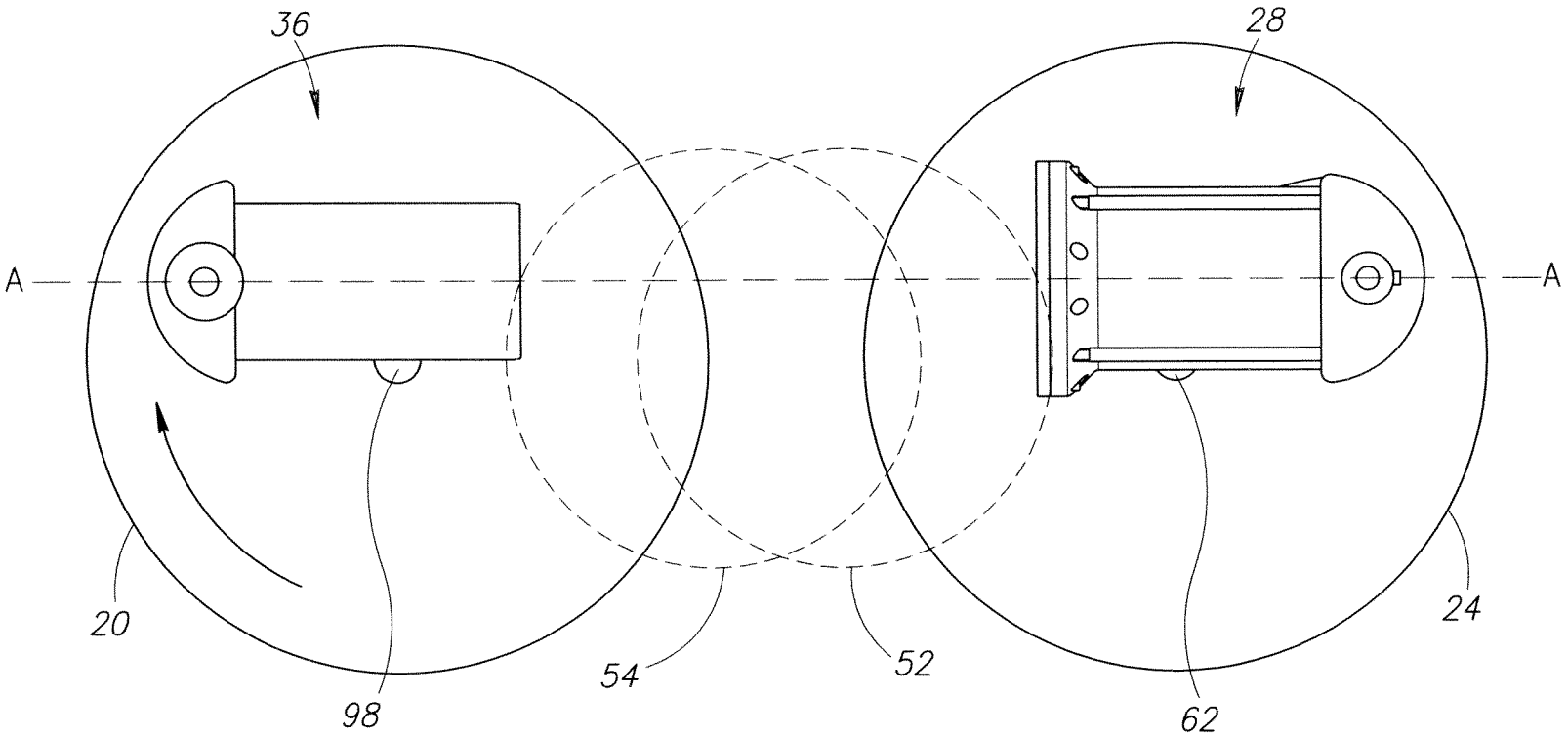
Figure 5:
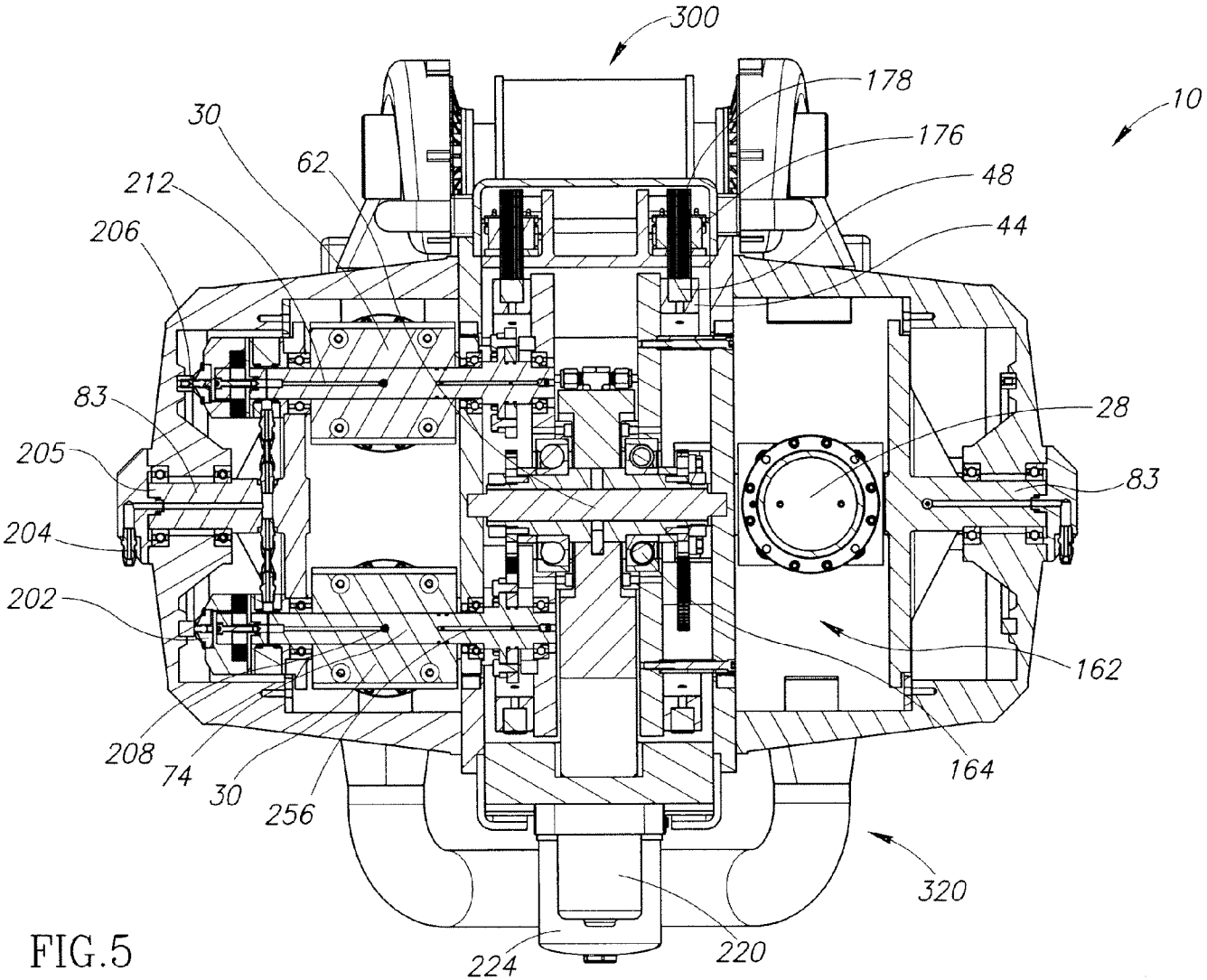
FIG. 5 is a cross-sectional side view of the engine cut through the axis of the cylinder wheel assembly along the line 5-5 shown in FIG. 13.
Figure 6:
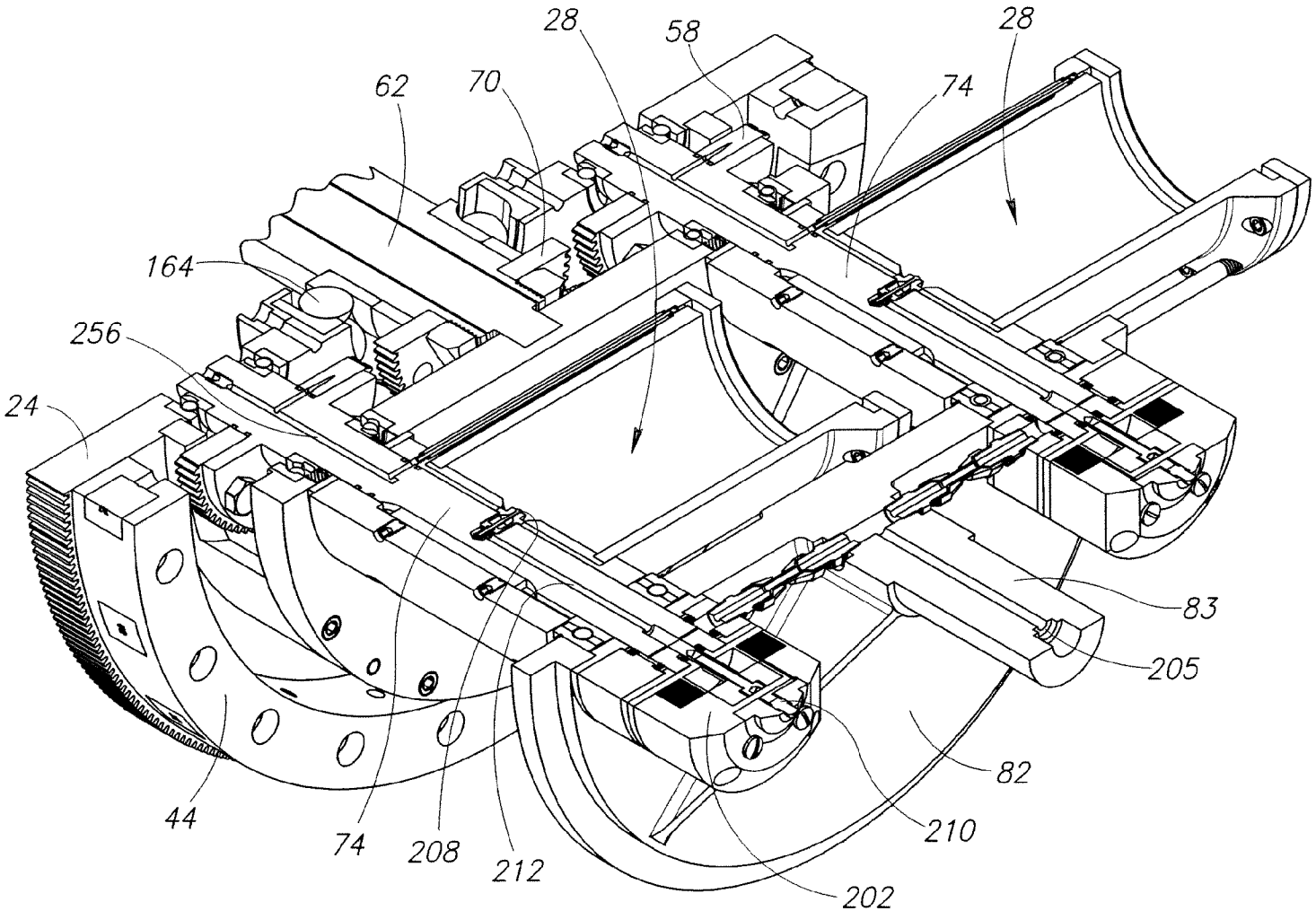
FIG. 6 is a cross-sectional perspective view of one-half of the cylinder drive wheel assembly.
Figure 7:
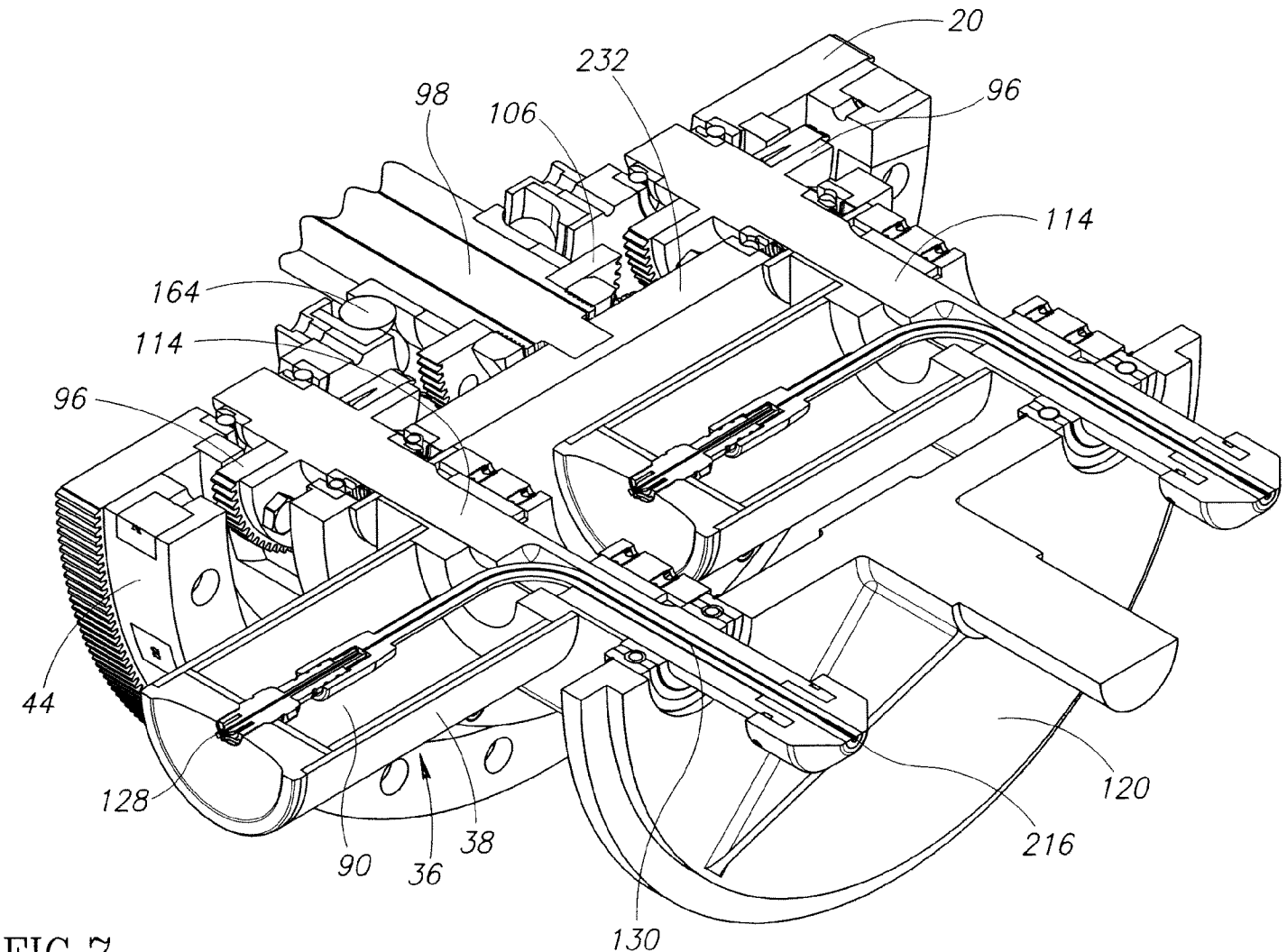
FIG. 7 is a cross-sectional perspective view of one-half of the piston drive wheel assembly.
Figure 8B:
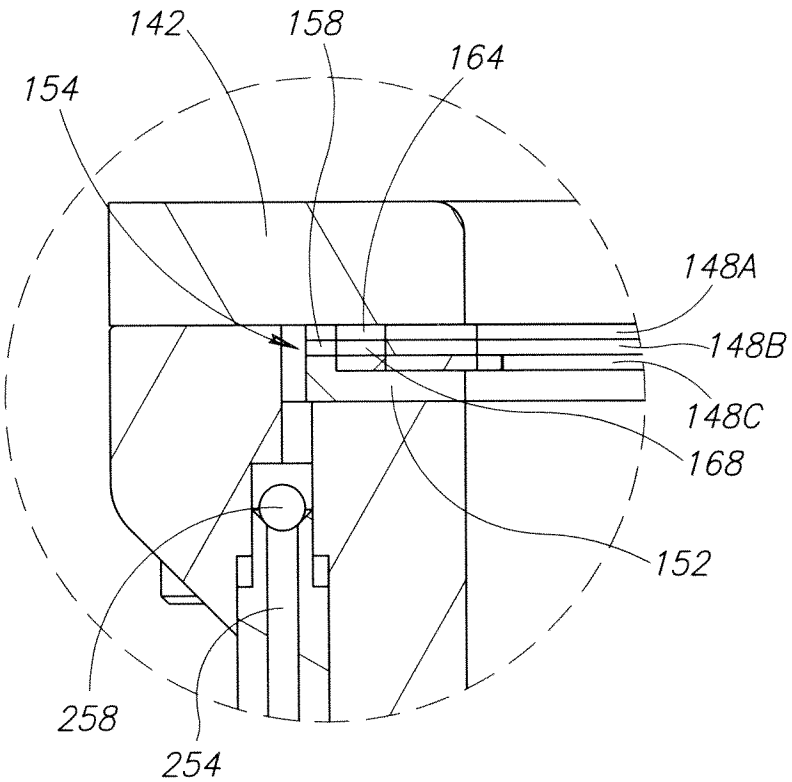
FIG. 8B is an enlarged view of the cylinder shown in FIG. 8A that illustrates floating cartridge set.
Figure 8A:
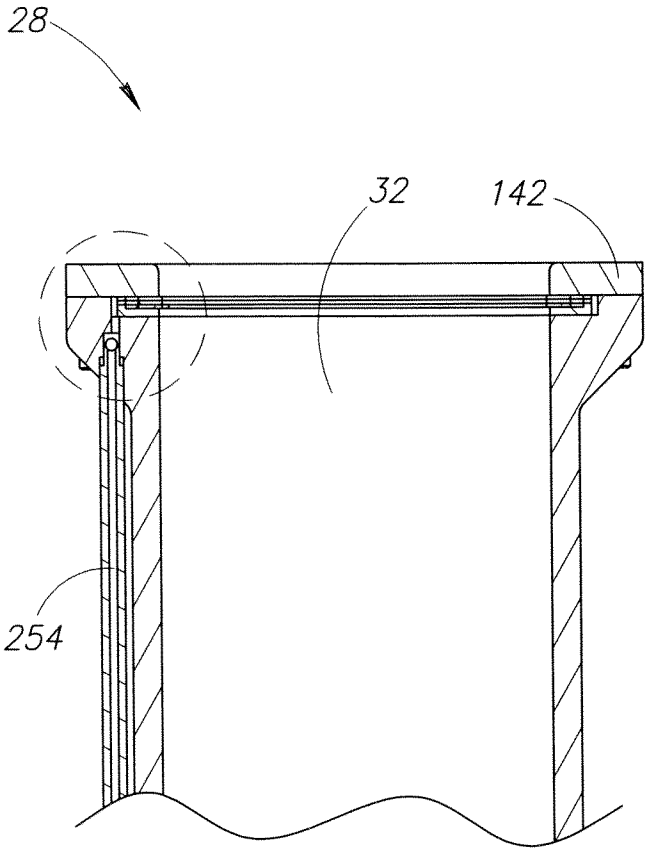
FIG. 8A is a cross-sectional side view of an upper portion of a cylinder of the engine.
Figure 8C:
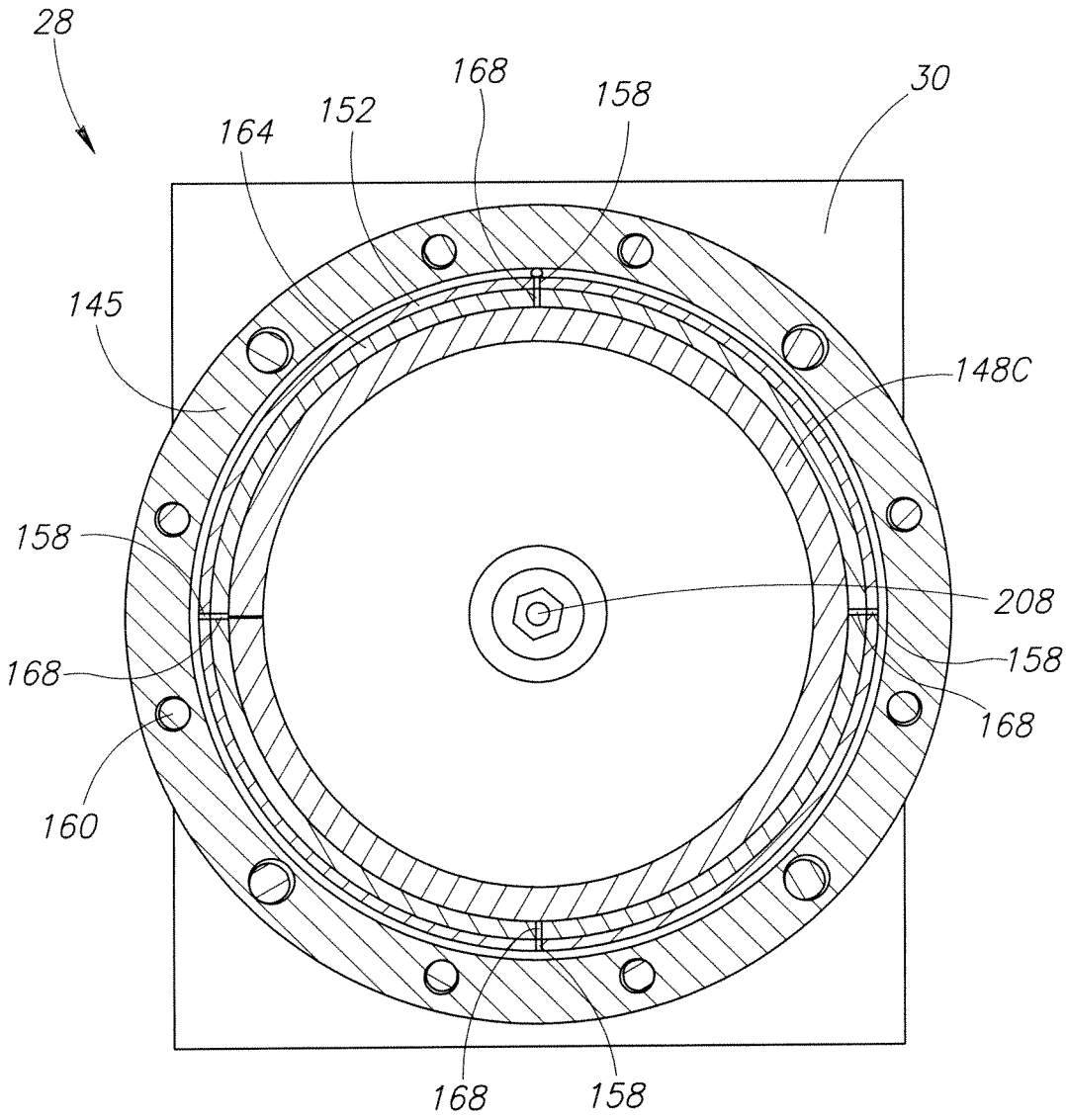
FIG. 8C is a top view of the cylinder shown in FIG. 8A.
Figure 13:
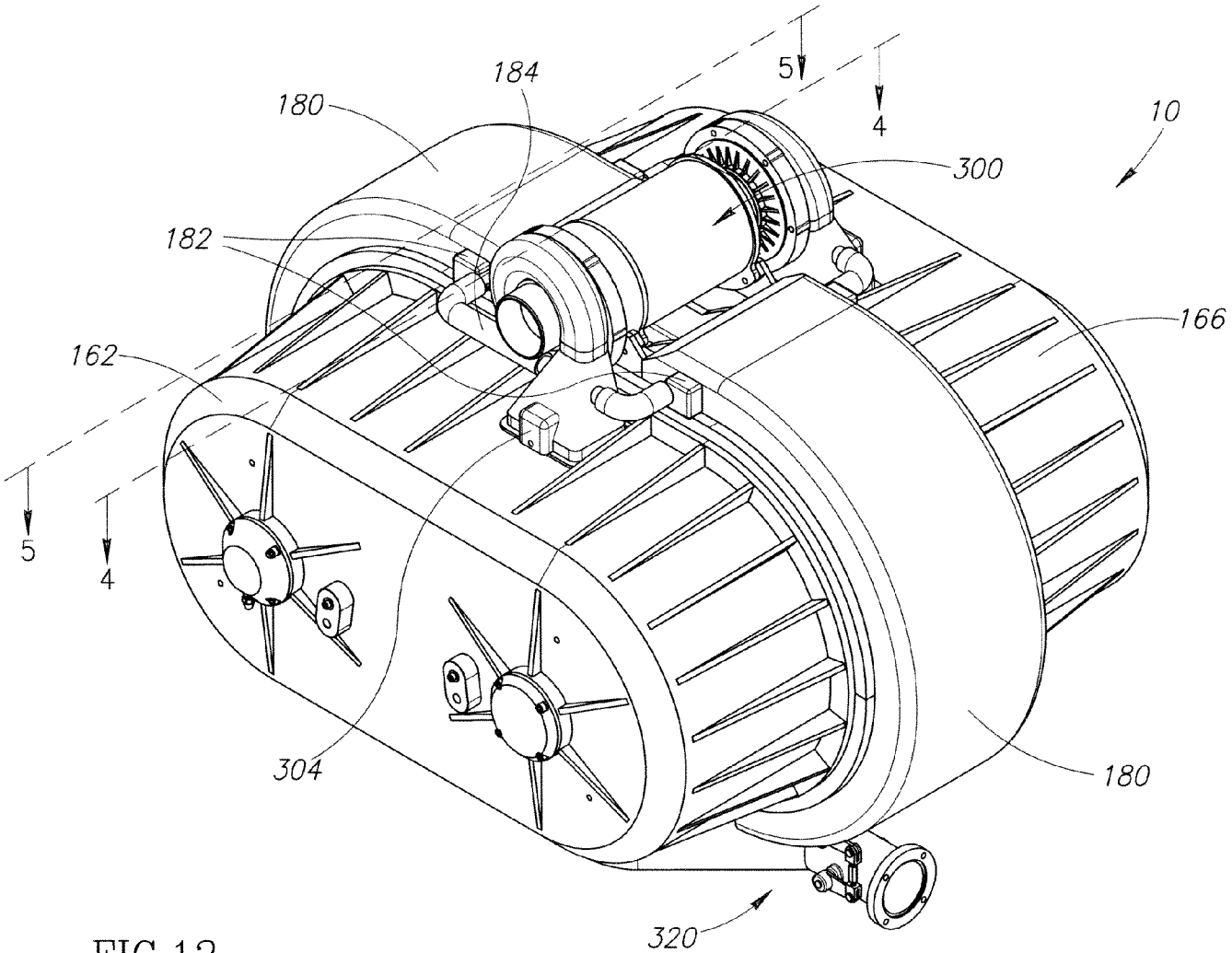
FIG. 13 is a perspective view of the assembled engine.

With reference now to the drawings in detail, and particularly FIG. 1, a piston drive wheel assembly 18 and a cylinder drive wheel assembly 14 for a combustible fluid-operated orbital engine 10 is shown. A fully assembled view of the engine 10 is shown in FIG. 13. The cylinder drive wheel assembly 14 comprises two substantially mirrored sets of two cylinders 28, and the piston drive wheel assembly 18 comprises two corresponding substantially mirrored sets of two pistons 36. The pistons 36 each comprise a piston head 40 coupled to a piston axle or shaft 114, and a piston body 38. The cylinders 28 each comprise a cylinder head 30 coupled to a cylinder axle or shaft 74, and a cylinder sleeve 32 configured for receiving a piston 36. Each of the pistons 36 are arranged so that they are at all times in opposed relation on a common longitudinal axis with a corresponding cylinder 28. As shown in FIGS. 2A-2D, the cylinders 28 and pistons 36 are configured for orbital motion along intersecting counter paths 52 and 54, respectively, defined by respective cylinder and piston carrier or drive gear wheels 24 and 20 (see FIG. 1). The carrier wheels 24 and 20 are best shown in FIG. 1 and are operative to rotate the respective cylinders 28 and pistons 36 in a circular motion along the paths 52 and 54 shown in FIGS. 2A-2D. The carrier wheels 20 and 24 are geared together such that they revolve in opposite direction. As shown in FIGS. 5 and 6, the two carrier wheels 24 of the cylinder drive wheel assembly 14 are coupled together via a cylinder carrier wheel drive link or axle 62. Ball bearings 164 (see FIG. 5) are provided to allow the carrier wheels 24 to rotate about the drive link 62. Similarly, as shown in FIG. 7, the two carrier wheels 20 of the piston drive wheel assembly 18 are coupled together via a piston carrier wheel drive link or axle 98.

Because the cylinders 28 and the pistons 36 are to remain on a common longitudinal axis A-A shown in FIGS. 2A-2D, they need to be turned on their transverse axes (i.e., rotated counter to the circular direction of movement to remain aligned within their corresponding piston/cylinder throughout 360 degrees of travel as they are carried circularly by the wheels 20, 24). The ratio of counter rotation of the cylinders 28 and the pistons 36 relative to the circular rotation of their respective carrier wheels 24 and 20 is whatever is needed to maintain the axial alignment on the common longitudinal axis A-A. Typically, this will be 1:1 in most embodiments.

The basic movement of each of the pistons 36 and cylinders 28 of the engine 10 is schematically illustrated in FIGS. 2A-2D. As shown, the piston carrier wheel 20 carries the piston 36 rotating clockwise (CW) on the circular path 54 about the axle 98. The cylinder carrier wheel 24 carrying the cylinder 28 is shown rotating counter clockwise (CCW) on the circular path 52 about the axle 62 that is parallel with the axle 98. The path 52 intersects the path 54 as shown. The piston 36 and the cylinder 28 are in alignment as they approach each other and as they depart each other as illustrated.

As shown in FIG. 1, gearing structure is provided to rotate the cylinders 28 and pistons 36 counter to their circular motion along paths 52 and 54 whereby their common longitudinal axis A-A relation is maintained despite the wheels 20 and 24 circular paths. That is, the cylinders 28 and pistons 36 are being carried circularly on their respective carrier wheels 24 and 20 about the axles 62 and 98 respectively, but gearing structure acts to rotate the cylinders and piston members about their respective axes defined by their respective axles 74 and 114 as they are carried circularly. The motion of the cylinders 28 and pistons 36 is both circular with the wheels 24 and 20, respectively, and simultaneously rotational about their own respective axes on axles 74 and 114, and thus orbital.

To achieve the aforementioned rotational and orbital motion, the shafts 74 and 114 of each of the cylinders 28 and pistons 36, respectively are coupled with a respective planetary gear 96 and 58 carried by the carrier wheels 24 and 20, which are in turn coupled to respective fixed center or common gears 70 and 106 via idler gears 116 and 117. This gearing structure operates to counter-rotate the cylinders 28 and pistons 36 in a 1:1 ratio to the rotation of their respective carrier wheels 24 and 20.

As discussed in further detail below, there is a combustible fluid supply to each of the cylinders 28 for combustion coincident with the periodic interfittment of the cylinders and pistons 36. A combustible fluid detonator comprising a spark plug 128 is operatively associated with each of the pistons 36. During operation, the carrier wheels 20 and 24 rotate under the explosive impetus of the detonation between one cylinder/ piston pair to bring the other cylinder/piston pair together, and so on, in a "circle cycle." The engine 10 is suitable for diesel operation by increasing compression and injector pressure, as well as for operation by steam, compressed gas, or other fluid energy source.

Figure 3:
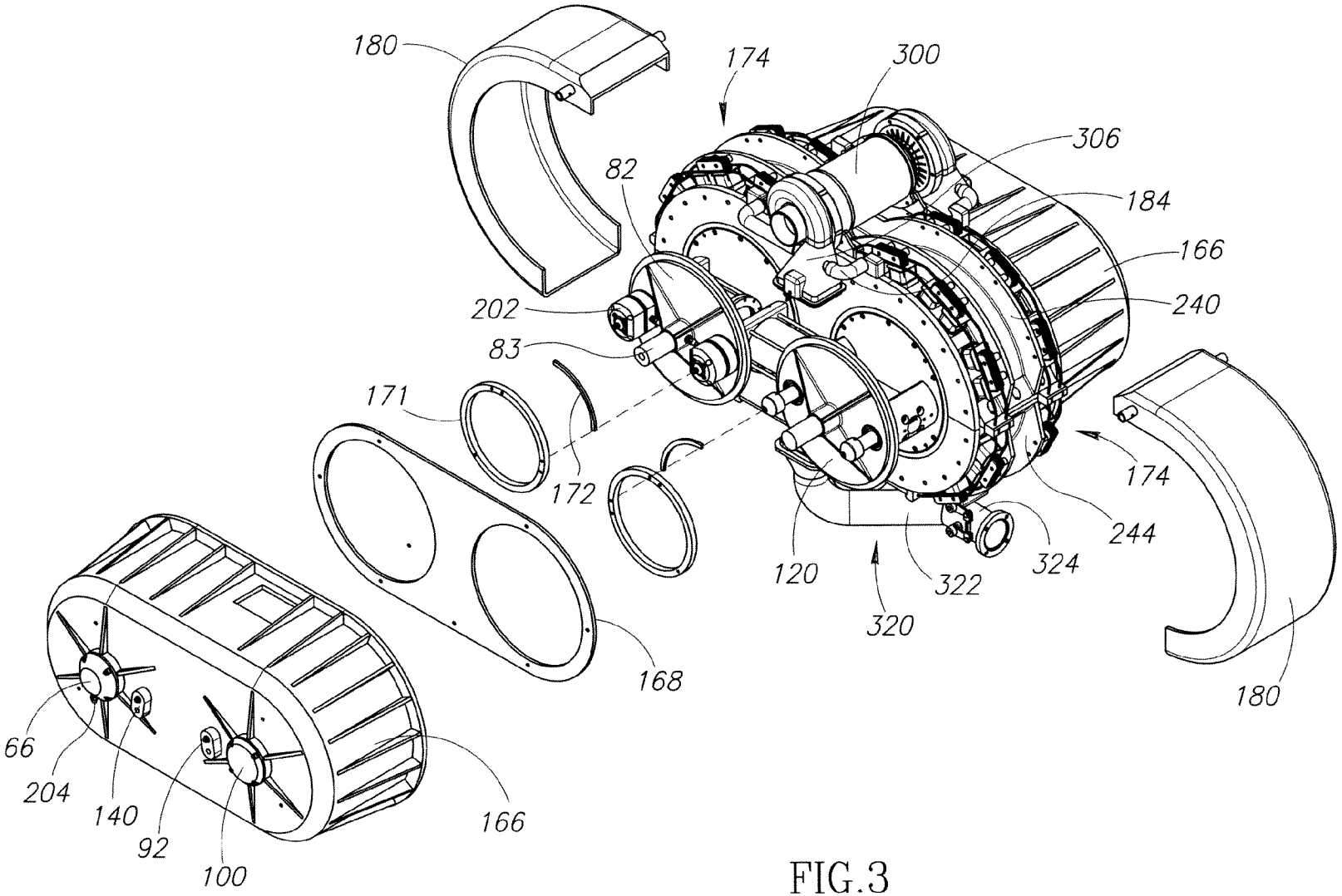
FIG. 3 is a partially exploded view of the engine shown in FIG. 1 with a side case and its associated components removed.

FIG. 3 illustrates a partially exploded perspective view of the engine 10. As shown, the engine 10 includes two mirrored side cases 166 that each operate to cover one set of the piston/cylinder pairs. The engine 10 also includes an oil case formed around the carrier wheels 20 and 24 that comprises a base 244, side plates 232 (see FIG. 4), and a cover 240. As may best be viewed in FIGS. 4 and 5, the engine 10 further comprises a pair of side case baffles 168 that, along with the oil case side plates 232 and the side cases 166, form an atmosphere control chamber 162 for each set of piston/cylinder pairs.

Notably, the center axles 62 and 98 do not extend through the atmosphere control chamber 162, the cylinder pivot shafts 74 are positioned outboard of the cylinders 28, and the piston pivot shafts 114 are positioned outboard of the pistons 36. Since the cylinders 28 and pistons 36 can be moved into the space extending along the same axis as the center axles 62 and 98, respectively, without interference therefrom, a higher horse power can be achieved for the same volume or envelope compared to an engine that includes center axles that extended outboard of the cylinders 28 and pistons 36. That is, in this embodiment, the pistons 36 and cylinders 28 do not need to be spaced apart to allow a center axle to pass through their respective axes of rotation.

Referring now to FIGS. 3, 5, and 6, fuel enters the engine 10 through a fuel-in port 204 coupled to the main cylinder outboard axle 83 of an outer drive plate 82 at an outer-most portion 205. The fuel is distributed to the cylinder axle 74 where it is injected via a fuel injector nozzle 208 into the center of the cylinder head 30 by a fuel injector solenoid 202, providing an ideal profile for combustion. The fuel injector solenoid 202 is activated by a computer control unit (CCU) through an electronic fuel control commutator 140 that is positioned on the side case 166. The electronic fuel control commutator 140 is electrically coupled to the solenoid 202 at a solenoid power in port 210 through a commutator base 171 and strip 172 attached to an inside surface of the side case 166 (see FIG. 3).

Referring now to FIGS. 3 and 7, the ignition for the engine 10 is also controlled by the CCU, which delivers energy to the spark plug 128 via an end portion 216 of a spark plug wire 130 that extends through the piston axles 114 (which extend outward an outer drive plate 120) to an ignition commutator 92. Similar to the fuel injector solenoid 202 discussed above, the spark plug wire 130 is coupled to the ignition commutator 92 through a commutator base 171 and strip 172 attached to the inside surface of the side case 166. As can be appreciated, in the diesel version of the engine 10, the ignition system is not needed since the heat of compression is used to initiate ignition to burn the fuel.

Figure 4:
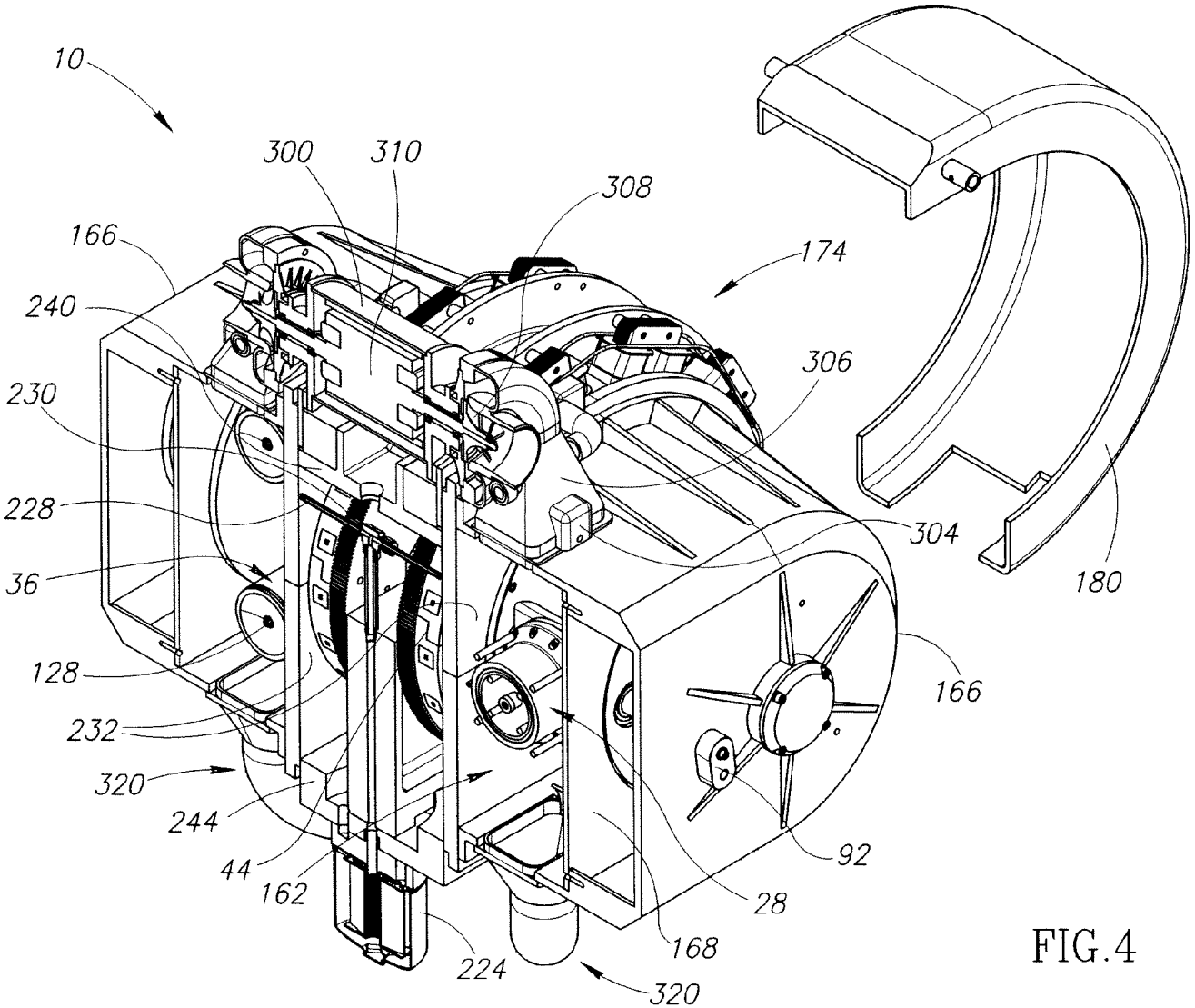
FIG. 4 is a cross-sectional perspective view of the engine illustrating the piston drive wheel assembly cut along the line 4-4 shown in FIG. 13.

The engine 10 also includes an oil pump 220 and an oil filter 224 configured to lubricate the gears of the engine. As shown in FIG. 4, oil is pumped from the oil filter 224 into the oil case via an oil distribution tube 230 and oil spray tubes 228.

Figure 12:
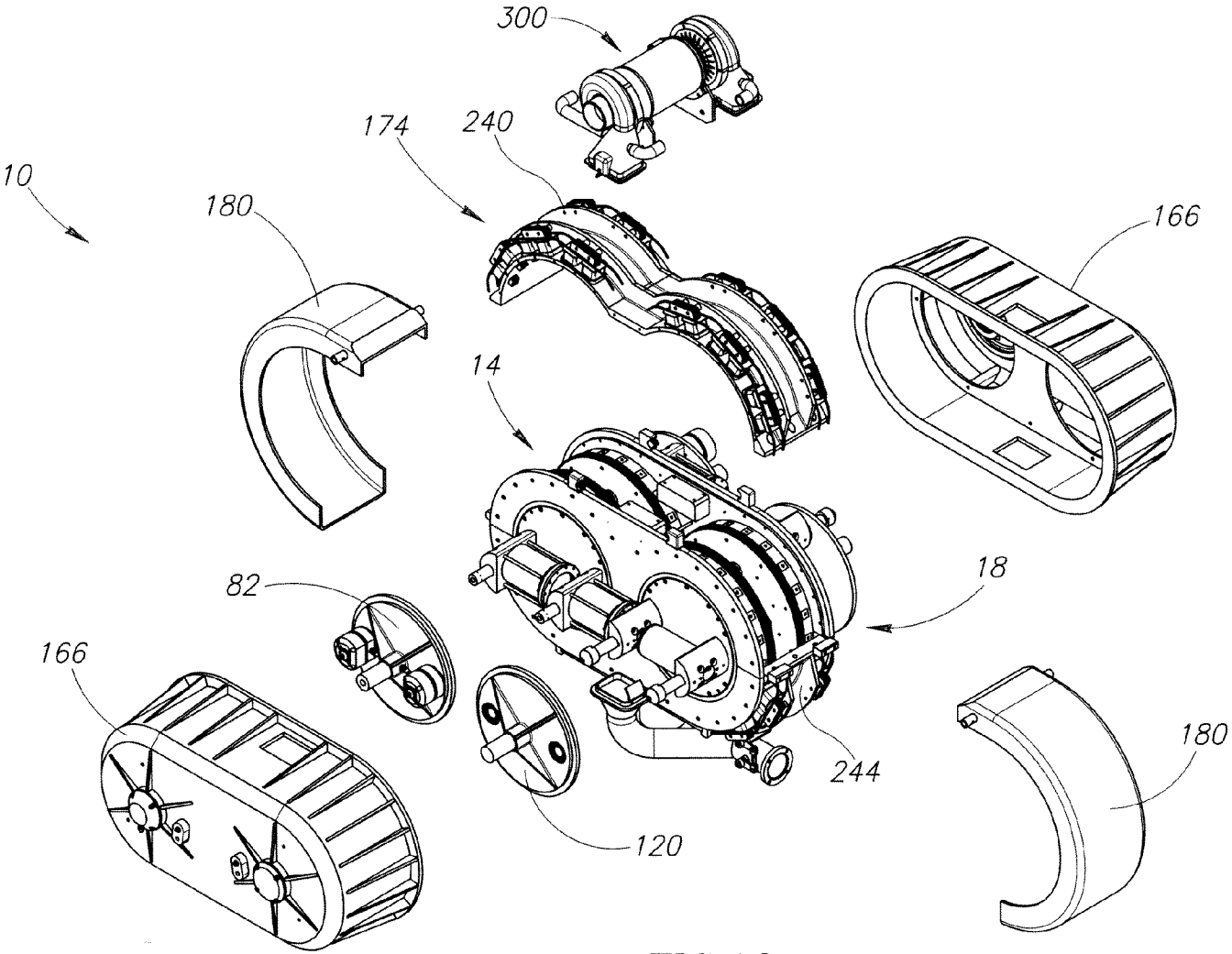
FIG. 12 is a partially exploded perspective view of the engine.

As discussed above, the physical nature of the present design is supportive of a built-in generator (and starter motor) for greater flexibility in power transfer. By using the engine structure as the generator core, there is a great savings in weight. As shown in FIG. 1, the carrier wheels 20 and 24 each include a permanent magnet hub 44 having a plurality of permanent magnets 48 distributed around its outer circumference to create the magnetic poles. In some embodiments, the magnets 48 are neodymium magnets, but other types may also be used. As shown in FIGS. 3 and 12, the permanent magnet hubs 44 are each surround by six stator assemblies 174 that are coupled to the oil case cover 240 and base 244. Each stator assembly 174 comprises a stator core 178, stator coil 176, insulator, etc., as is known in the art. In operation, the rotation of the magnet hubs 44 causes a magnetic flux with a polarity opposite to the stator (i.e., cutting the stator coils 176), causing active current to be produced in the stator coils 176, which may be used to provide power in a variety of applications that require electrical power.

Figure 11:
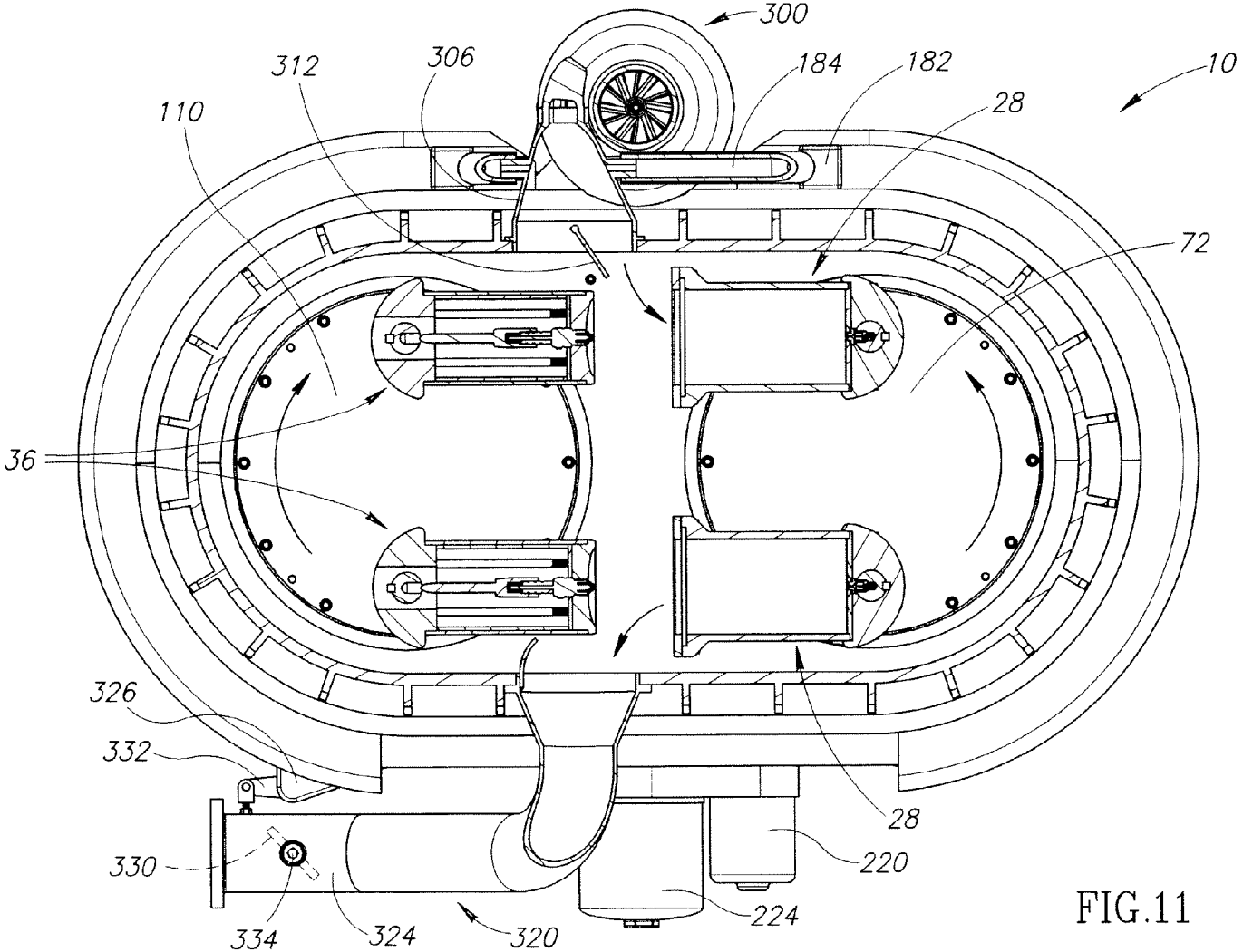
FIG. 11 is a cross-sectional side view of the engine illustrating the operation of its blower assembly and exhaust system.

The engine 10 also comprises a breathing system that includes a blower assembly 300 and an exhaust system 320. As may best be viewed in FIG. 4, the blower assembly 300 includes a blower motor 310 and blower impellers 308. The blower assembly 300 also includes two volutes 306, each being directed into one of the atmosphere control chambers 162. As shown in FIG. 11, the blower assembly 300 also includes a cylinder purge flap or baffle 312 that is selectively positionable by a purge flap actuator 304 (see FIG. 4). The blower assembly 300 also includes stator vent or cooling tubes 184 that are controlled by thermostatically controlled valves 182. As shown in FIG. 12, the stator assemblies 174 are covered by stator cooling shrouds 180.

The exhaust system 320 comprises two exhaust headers 322 each extending downward from one of the atmosphere control chambers 162 that come together at a common header 324. An exhaust control valve actuator 326 is provided and is operatively coupled to a butterfly valve 330 (shown in dashed lines) in the common header 324 via a lever arm 322 and a butterfly valve shaft 334.

In operation, the computer control unit (CCU) controls the blower assembly 300, the exhaust control valve actuator 326, and the cylinder purge flap 312. A positive pressure may be maintained in the atmosphere control chambers 162 by regulating the exhaust system 320 and the speed of the blower assembly 300. At low engine speed, some of the exhaust gases may be re-circulated to limit the oxygen available in the combustion chambers of the cylinders 28. As the speed of the engine 10 increases, the exhaust control valve 330 may be gradually opened and the cylinder purge flap 312 can be moved towards the opening of the cylinders 28, as shown in FIG. 11. Engine cooling is controlled by increasing the output of the blower assembly 300 as needed.

Referring now to FIGS. 8A-C, 9, and 10, unlike other piston/cylinder operating systems, the engine 10 has the compression sealing system located in the entry of each cylinder 28 rather than connected to the piston 36. Because the piston 36 does not come into contact with the cylinder 28, lubrication of the walls of the cylinder 28 is not required. As can be appreciated, this design reduces friction and wear. The piston 36 is lubricated via split compression sealing rings 148A, 148B, and 148C. To allow for possible misalignment of the piston 36 and cylinder 28, the compression sealing rings 148A-C are incorporated in a ring holder or cartridge 152. The cartridge 152 has four primary functions: (1) holding the rings 148A-C in an aligned position for entry of the piston 36 (i.e., the cartridge 152 is allowed to float under friction loading); (2) keeping the splits 150A-C of the rings 148A-C, respectively, 120 degrees apart from each other; (3) allowing the rings 148A-C to expand and maintain a seal on the piston 36; and (4) providing lubrication to the ring/piston interface.

Figure 9:
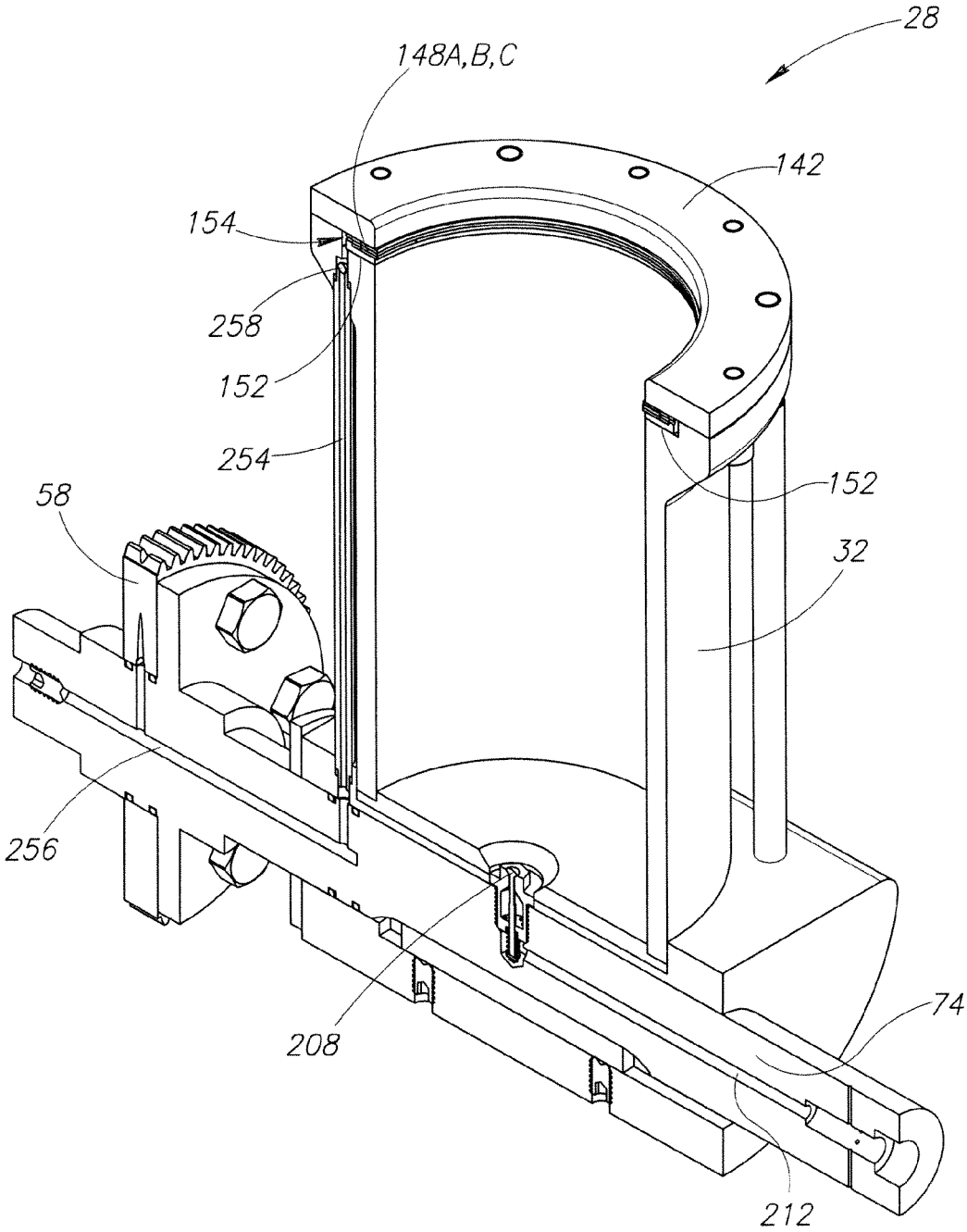
FIG. 9 is a cross-sectional perspective view of the cylinder illustrating a lube oil feed tube, a lube oil check valve, and the floating cartridge set.
Figure 10:
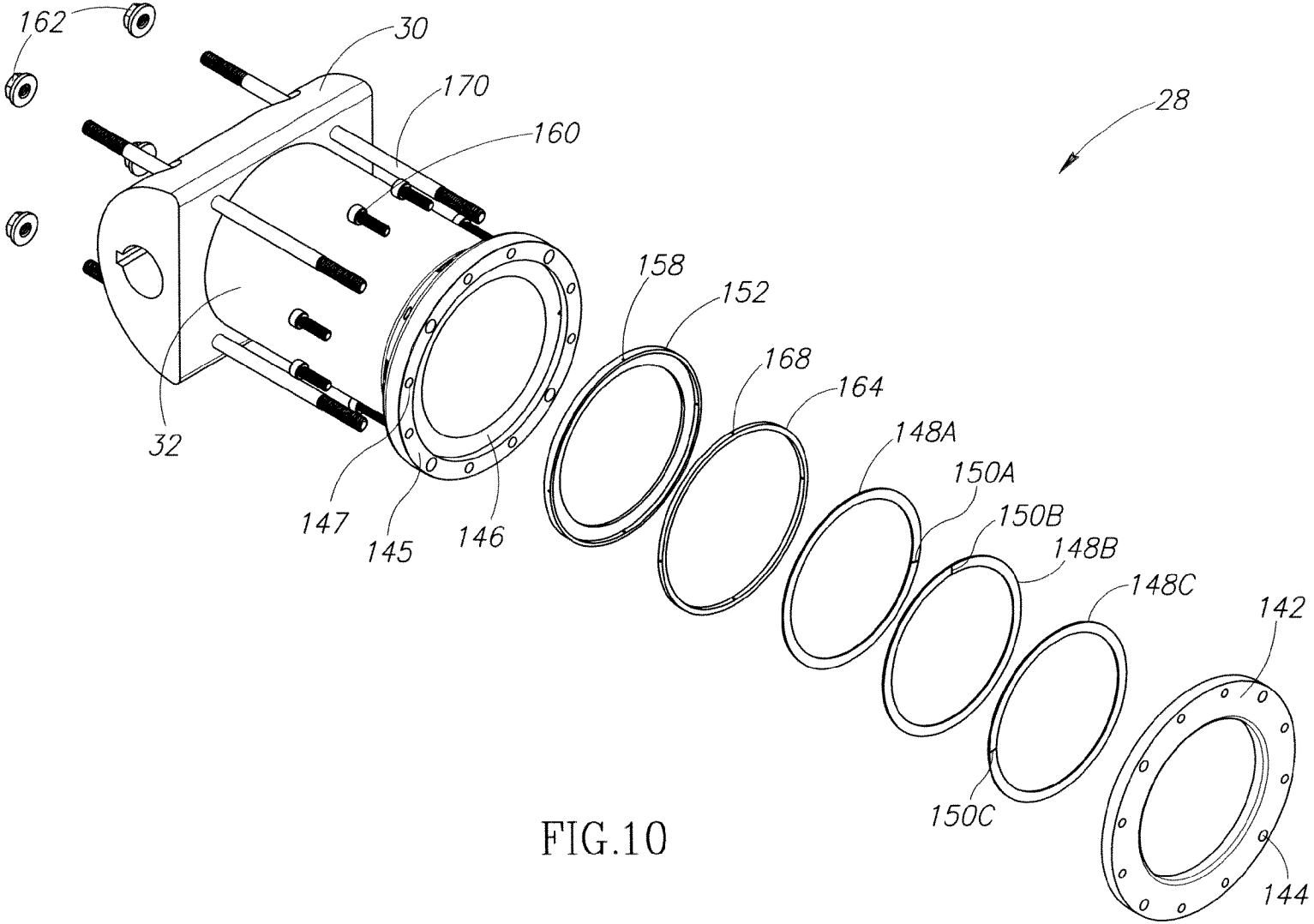
FIG. 10 is an exploded perspective view of the cylinder that illustrates the components of the floating cartridge set.

As shown in FIG. 9, ring cartridge lubricating oil is passed via centrifugal force from the gearbox through the cylinder axle 74 and a coupling tube 256. There is a check valve 258 to prevent gases from the cylinder 28 from reversing this very small fluid flow. The oil is distributed from a floating gap 154 around the circumference of the cartridge 152 to both sides of the middle ring 148B through four small holes 158 in the cartridge 152 and four small holes 168 in an elastomeric ring cartridge buffer 164. This feature eliminates the need to add lubricating oil in with the fuel as is typically required with other two cycle engines. As can be appreciated, this results in a much cleaner exhaust.

The cartridge 152 and compression rings 148A-C are contained within a recessed portion 146 in a rim portion 145 of the cylinder sleeve 32 by a containment ring 142. The containment ring 142 and the rim portion 145 include holes configured to receive a plurality of threaded screws 160 and studs 170 so that the containment ring 142 may be secured to the cylinder sleeve 32 using a plurality of nuts 162.

In some embodiments, the cylinder sleeve 32 and a piston liner or insulator 90 made from a ceramic material is provided. Because the piston 36 is not in contact with the cylinder 28 wall and because both the cylinder and the piston are allowed to "breath" independently after each power stroke, a transfer of heat between them is not required. This allows the use of low thermal conducting ceramics to convert more of the combustion heat energy into mechanical energy, greatly increasing the thermal efficiency of the engine.

Figure 14:
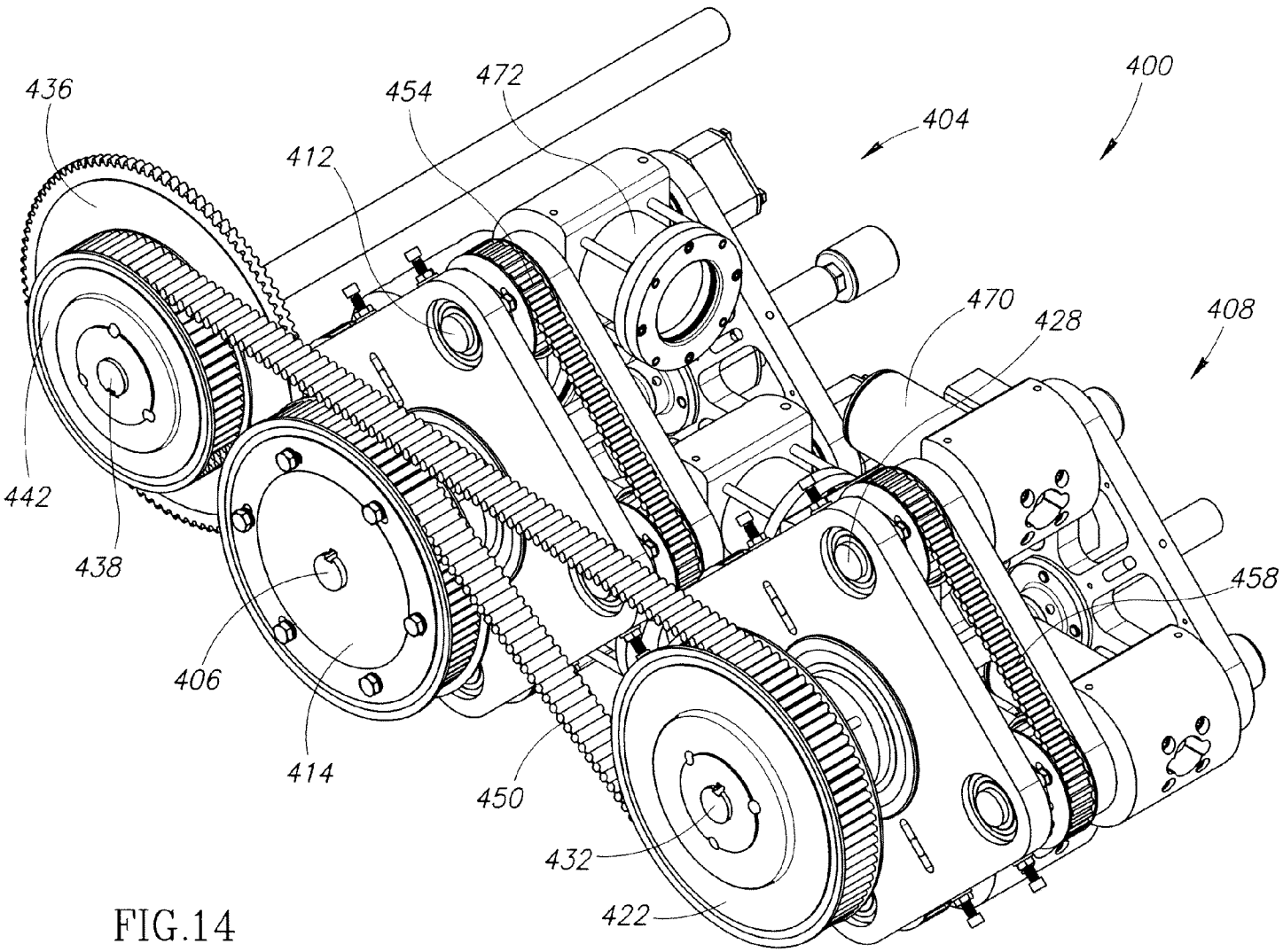
FIG. 14 is a perspective view of a cylinder drive wheel assembly and a piston drive wheel assembly of an engine according to another embodiment of the present invention that utilizes toothed belts instead of mechanical gears.
Figure 15:
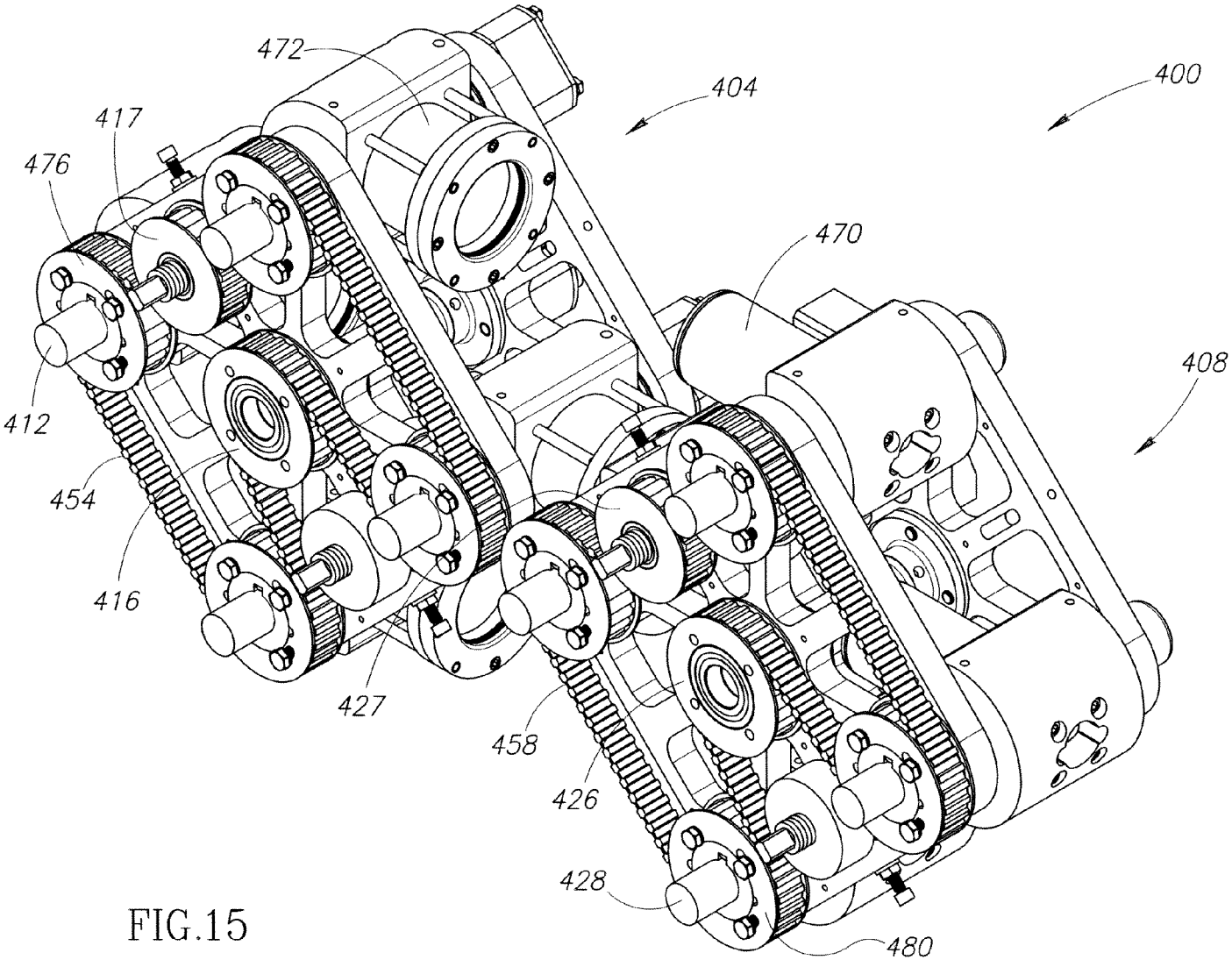
FIG. 15 is a perspective view of the cylinder drive wheel assembly and the piston drive wheel assembly of the engine shown in FIG. 14 illustrating the piston assembly belt and the cylinder assembly belt.

FIGS. 14 and 15 illustrate another embodiment of an engine 400 in accordance with the present invention. The engine 400 is similar to the engine 10 discussed above in many respects, so the discussion of this embodiment is limited to certain aspects only. In this embodiment, the rotational and orbital motion of the pistons 470 and the cylinders 472 is provided by belts and sprockets, rather than mechanical gears. As can be appreciated, this feature eliminates the need for an oiled gearbox.

The engine 400 includes cylinder drive wheel assembly 404 comprising a bank of four cylinders 472 and a piston drive wheel assembly 408 comprising a bank of four corresponding pistons 470. The cylinders 472 rotate about a main cylinder shaft 406 and the pistons 470 rotate about a main piston shaft 432. A starter gear 436 is coupled to a starter (not shown) and to a sprocket 442 on an idler shaft 438. The sprocket 442 is coupled to the main cylinder shaft 406 and the main piston shaft 432 via a starter belt 450 and sprockets 414 and 422, respectively. Thus, the belt 450 links the cylinder drive wheel assembly 404 to the piston drive wheel assembly 408.

As shown in FIG. 15, the orbital motion of the pistons 470 is controlled by a belt 458 positioned around piston sprockets 480 coupled to drive shafts 428, a fixed center sprocket 426, and an idler sprocket 427. Similarly, the orbital motion of the cylinders 472 is controlled by a belt 454 positioned around cylinder sprockets 476 coupled to drive shafts 412, a fixed center sprocket 416, and an idler sprocket 417. Thus, the rotational and orbital motion of the cylinders 472 and pistons 470 may be produced using these sprockets and belts, such that the cylinder and piston carrier wheel assemblies 404, 408 carry the pistons/cylinders circularly and orbitally and at all times in opposed relation on a common longitudinal axis along intersecting counter paths.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

We claim:

1. A combustible fluid-operated orbital engine, comprising:

one or more cylinders in which each cylinder has a longitudinal axis and is carried on a rotating cylinder wheel for orbital motion and is adapted to receive the combustible fluid, the cylinder wheel being rotatable about an axle along an first axis of rotation, wherein at least a portion of the one or more cylinders intersects the first axis during its orbital motion; and one or more corresponding pistons carried on a counter-rotating piston wheel for opposite orbital motion, the piston wheel being rotatable about an axle along an second axis of rotation parallel to the first axis, wherein at least a portion of the one or more pistons intersects the second axis during its orbital motion, each of the pistons having a cooperating cylinder and having throughout its movement the same longitudinal axis as its cooperating cylinder to oppose and sequentially enter and completely withdraw from its cooperating cylinder on the same longitudinal axis.

2. The combustible fluid-operated orbital engine of claim 1, wherein at least one of the one or more cylinders and the one or more pistons comprises a ceramic material.

3. The combustible fluid-operated orbital engine of claim 1, wherein the one or more pistons each comprise a piston head coupled to a piston axle, the piston axle being coupled to the piston wheel, and the one or more cylinders each comprise a cylinder head coupled to a cylinder axle, the cylinder axle being coupled to the cylinder wheel.

4. The combustible fluid-operated orbital engine of claim 1, wherein the cylinder and piston wheels rotate on respective hubs having a plurality of permanent magnets positioned thereon, the engine further comprising a plurality of stator assemblies disposed around the hubs that are operative to provide power in response to rotation of the hubs.

5. The combustible fluid-operated orbital engine of claim 1, further comprising respective gearing structures supported by the cylinder wheel and piston wheel and operative to rotate the cylinders and pistons counter to their circular motion direction to maintain their opposed relation for periodic interfittment when their respective paths intersect.

6. The combustible fluid-operated orbital engine of claim 1, further comprising respective sprocket and belt assemblies supported by the cylinder wheel and piston wheel and operative to rotate the cylinders and pistons counter to their circular motion direction to maintain their opposed relation for periodic interfittment when their respective paths intersect.

7. The combustible fluid-operated orbital engine of claim 1, further comprising a combustible fluid supply to the cylinder in timed relation with piston entry into the cylinder for compression, detonation, and exhaust.

8. The combustible fluid-operated orbital engine of claim 7, wherein the one or more cylinders each comprise a cylinder head coupled to a cylinder axle, the cylinder axle including a fuel tube for delivering fuel to a fuel injector nozzle operatively coupled to the cylinder.

9. The combustible fluid-operated orbital engine of claim 8, further comprising a fuel injector solenoid coupled to the fuel tube, the solenoid being configured to receive power from an electronic fuel control commutator.

10. The combustible fluid-operated orbital engine of claim 1, further comprising a combustible fluid detonator operatively associated with each piston.

11. The combustible fluid-operated orbital engine of claim 10, wherein the combustible fluid detonator comprises a spark plug.

12. The combustible fluid-operated orbital engine of claim 10, wherein the one or more pistons each comprise a piston head coupled to a piston axle, the piston axle being coupled to the piston wheel and including an electrical connection to the combustible fluid detonator, wherein the combustible fluid detonator receives ignition-timing signals via an ignition commutator.

13. The combustible fluid-operated orbital engine of claim 1, further comprising a blower assembly and an exhaust system configured to control the pressure, air quality, and cooling of the pistons and cylinders during operation of the engine.

14. The combustible fluid-operated orbital engine of claim 1, wherein each of the one or more cylinders comprises a compression sealing system located in the entry of the cylinder, the compression sealing system comprising a cartridge for holding a plurality of split compression sealing rings.

15. The combustible fluid-operated orbital engine of claim 14, further comprising lubrication tube communicatively coupled with the cartridge and configured to provide lubrication to the plurality of split compression sealing rings.

16. The combustible fluid-operated orbital engine of claim 15, wherein the cartridge is movable relative to the cylinder in a direction transverse to the cylinder's longitudinal axis to allow for possible misalignment of the cylinder and its corresponding piston.

17. The combustible fluid-operated orbital engine of claim 1, wherein the one or more cylinders comprises a plurality of cylinders and the one or more pistons comprises a plurality of pistons, and wherein the longitudinal axis of each piston-cylinder pair is at all times parallel to the respective longitudinal axes of each other cooperating cylinder and piston pairs.

18. A combustible fluid-operated orbital engine, comprising:

plural sets of cooperating cylinders and piston members arranged at all times in opposed relation on a common longitudinal axis for circular and orbital motion along intersecting counter paths, wherein each of cylinders comprises a recessed portion positioned at the entry of the cylinder that contains a compression sealing system, the compression sealing system comprising a cartridge having a plurality of split compression sealing rings positioned therein configured to provide a seal on a corresponding piston member during periodic interfittment of the cylinders and their corresponding piston members;

gearing structure operative to rotate the members counter to their the orbital motion to maintain their opposed relation for their periodic interfittment where their respective paths intersect, and a combustible fluid supply to the cylinder member for combustion coincident with their periodic interfittment in engine operating relation, the common longitudinal axes of the sets being at all times parallel with each other.

19. A method of operating a combustible fluid-operated orbital engine, comprising:

disposing plural sets of cooperating cylinder and piston members having respective parallel axes of rotation at all times in opposed relation on a common longitudinal axis;

carrying the members circularly along intersecting counter paths on respective cylinder and piston carrier wheels having axes of rotation parallel to the members' axes of rotation while simultaneously rotating the members counter to their circular motion in orbital relation sufficiently to maintain their disposition on the common longitudinal axis, wherein the members intersect the respective axes of rotation of the cylinder and piston carrier wheels during rotation;

periodically interfitting the members where their respective paths intersect; and supplying a combustible fluid in the cylinder for detonation responsive to the members' interfittment in engine operating relation.

20. The method of claim 19, further comprising:

driving rotation of each member with a respective planetary gear carried by its respective carrier wheel;

driving the planetary gears with a center gear rotating with a respective carrier wheel to maintain common longitudinal axis orientation of the members; and peripherally engaging the carrier wheels with each other for equal and opposite relative rotation.

* * * * *

UNITED STATES PATENT AND TRADEMARK OFFICE

CERTIFICATE OF CORRECTION

PATENT NO. : 8,555,830 B2
APPLICATION NO. : 13/273587
DATED : October 15, 2013
INVENTOR(S) : James Lockshaw et al.

It is certified that error appears in the above-identified patent and that said Letters Patent is hereby corrected as shown below:

In the Claims:

Claim 1, Column 8, Line 51 that reads "axle along an first axis of rotation, wherein at least a" should read --axle along a first axis of rotation, wherein at least a--.

Claim 1, Column 8, Line 56 that reads "piston wheel being rotatable about an axle along an" should read --piston wheel being rotatable about an axle along a--.

Claim 15, Column 9, Line 61 that reads "14, further comprising lubrication tube communicatively" should read --14, further comprising a lubrication tube communicatively--.

Claim 18, Column 10, Line 26 that reads "gearing structure operative to rotate the members counter" should read --a gearing structure operative to rotate the members counter--.

Claim 18, Column 10, Line 27 that reads "to their the orbital motion to maintain their opposed" should read --to their orbital motion to maintain their opposed--.

Signed and Sealed this
Twenty-eighth Day of January, 2014

Michelle K. Lee

Michelle K. Lee
*Deputy Director of the United States Patent and Trademark Office*